US009932149B2

(12) United States Patent
Puccini

(10) Patent No.: US 9,932,149 B2
(45) Date of Patent: Apr. 3, 2018

(54) PACKAGE WITH INTEGRALLY FORMED HANDLE AND METHOD OF MAKING THE SAME

(71) Applicant: The Procter & Gamble Company, Cincinnati, OH (US)

(72) Inventor: Pedro José Puccini, Caracas (VE)

(73) Assignee: The Procter & Gamble Company, Cincinnati, OH (US)

( * ) Notice: Subject to any disclaimer, the term of this patent is extended or adjusted under 35 U.S.C. 154(b) by 320 days.

(21) Appl. No.: 13/899,809

(22) Filed: May 22, 2013

(65) Prior Publication Data

US 2014/0348444 A1 Nov. 27, 2014

(51) Int. Cl.

| | |
|---|---|
| ***B65D 33/10*** | (2006.01) |
| ***B65D 33/08*** | (2006.01) |
| ***B65B 5/06*** | (2006.01) |
| ***B65D 75/30*** | (2006.01) |
| ***B65D 75/56*** | (2006.01) |
| ***B65D 30/08*** | (2006.01) |
| ***B65D 30/18*** | (2006.01) |

(52) U.S. Cl.

CPC ..... *B65D 33/08* (2013.01); *B65B 5/06* (2013.01); *B65D 31/04* (2013.01); *B65D 31/08* (2013.01); *B65D 75/30* (2013.01); *B65D 75/566* (2013.01)

(58) Field of Classification Search

CPC ..... B65D 75/5833; B65D 85/16
USPC ..... 383/10
See application file for complete search history.

(56) References Cited

U.S. PATENT DOCUMENTS

| | | | | | |
|---|---|---|---|---|---|
| 2,625,318 | A * | 1/1953 | Ross | B65D 33/105 | 383/14 |
| 3,647,058 | A * | 3/1972 | Farguhar | B65D 75/52 | 206/431 |
| 4,252,236 | A * | 2/1981 | Roccaforte | B65D 5/725 | 206/449 |
| 4,252,269 | A * | 2/1981 | Peppiatt | B65D 33/10 | 383/10 |
| 4,867,575 | A * | 9/1989 | Wood | B65D 33/06 | 383/10 |
| 4,874,255 | A * | 10/1989 | Ball | B65D 75/563 | 383/29 |

(Continued)

FOREIGN PATENT DOCUMENTS

| | | |
|---|---|---|
| EP | 0 669 204 | 8/1995 |
| EP | 2 046 661 | 11/2010 |
| GB | 961178 | 6/1964 |

*Primary Examiner* — Derek Battisti
(74) *Attorney, Agent, or Firm* — Sarah M. DeCristofaro; Abbey A. Lopez

(57) ABSTRACT

A package includes a first panel and a second panel, wherein each of the first and second panels defines a right side edge portion, a left side edge portion, a first end portion, and a second end portion. The package includes a pleat that interconnects between the first end portions of the first and second panels. The pleat defines a right side edge portion and a left side edge portion and includes a handle aperture forming a handle. A first seam joins the right side edge portions of the first panel, the second panel, and the pleat and a second seam joins the left side edge portions of the first panel, the second panel, and the pleat. A third seam joins the second end portion of the first panel with the second end portion of the second panel. The first panel, the second panel, and the pleat are integrally formed.

19 Claims, 20 Drawing Sheets

(56) References Cited

U.S. PATENT DOCUMENTS 5,054,619 A * 10/1991 Muckenfuhs ..... 206/494
5,121,995 A 6/1992 Newman et al.
5,163,558 A * 11/1992 Palumbo et al. ..... 206/494
5,361,905 A * 11/1994 McQueeny ..... B65D 75/527 206/494
5,377,837 A * 1/1995 Roussel ..... 206/494
5,427,245 A * 6/1995 Roussel ..... 206/494
5,439,166 A 8/1995 Focke
5,655,843 A * 8/1997 Conrad ..... B31B 19/86 206/494
5,722,774 A * 3/1998 Hartz ..... 383/207
H1748 H * 9/1998 Marinelli ..... 206/83.5
5,934,470 A * 8/1999 Bauer et al. ..... 206/494
6,206,571 B1 3/2001 Olin
6,228,450 B1 5/2001 Pedrini
6,517,660 B2 2/2003 Ausnit
6,601,705 B2 * 8/2003 Molina ..... A61F 13/551 206/440
7,262,335 B2 8/2007 Motsch et al.
7,353,949 B2 * 4/2008 Osterdahl ..... A61F 13/15747 206/440
8,074,803 B2 * 12/2011 Motsch ..... B65D 75/5833 206/440
8,287,512 B2 10/2012 Gabriele
8,490,793 B2 * 7/2013 Evenson et al. ..... 206/494
2004/0131285 A1 7/2004 Shepard et al.
2006/0030471 A1 2/2006 Schaller et al.
2006/0096880 A1 * 5/2006 Zander et al. ..... 206/440
2006/0124494 A1 * 6/2006 Clark, Jr. ..... B65D 75/5833 206/440
2007/0219521 A1 9/2007 Hird et al.
2008/0118191 A1 5/2008 Garger
2011/0139657 A1 6/2011 Hird et al.
2011/0139658 A1 6/2011 Hird et al.
2011/0139659 A1 6/2011 Hird et al.
2011/0139662 A1 6/2011 Hird et al.
2011/0152812 A1 6/2011 Hird et al.

* cited by examiner

PACKAGE WITH INTEGRALLY FORMED HANDLE AND METHOD OF MAKING THE SAME

FIELD

The present disclosure relates to packages, and more particularly, to packages having an integrally formed handle and a method of making the same.

BACKGROUND

The field of disposable absorbent articles includes a wide variety of consumer products, including diapers, bibs, wipes, sanitary napkins, and tampons. In some cases, the absorbent articles are packaged in a primary package, such as a polybag. A plurality of primary packages containing absorbent articles may be packaged in a secondary package, such as a cardboard box.

Primary packages for containing absorbent articles may include opposing first and second panels. Each panel may define a left side edge portion, a right side edge portion, a top end portion, and a bottom end portion. The first and second panels may be joined at a first seam along right side edge portions of the first and second panels and at a second seam along left edge portions of the first and second panels. The primary packages may include a handle. The handle may be connected at various locations on the package. In some packages, the handle is a separate piece of material that may be attached to the package. However, the attached handle may hinder access to the interior of the package. Also, the attached handle may not appear to be durable and may not be aesthetically pleasing to consumers as the handle may become wrinkled or folded during shipping and handling of the package. Furthermore, attaching a separate handle to the package may add cost and complexity the manufacturing process.

Thus, it would be beneficial to provide a package comprising an integrally formed handle and a method of making the same.

SUMMARY

Aspects of the present disclosure include a package comprising a first panel, wherein the first panel defines a right side edge portion, a left side edge portion, a first end portion, and a second end portion. The package includes a second panel, wherein the second panel defines a right side edge portion, a left side edge portion, a first end portion, and a second end portion, wherein the first and second panels combine to define an interior and an exterior of the package. The package includes a pleat that interconnects between the first end portions of the first and second panels, wherein the pleat defines a right side edge portion and a left side edge portion, wherein the pleat comprises a handle aperture forming a handle. A first seam joins the right side edge portions of the first panel, the second panel, and the pleat and a second seam joins the left side edge portions of the first panel, the second panel, and the pleat. A third seam joins the second end portion of the first panel with the second end portion of the second panel. The first panel, the second panel, and the pleat are integrally formed.

Aspects of the present disclosure include a package comprising a first panel, wherein the first panel defines a right side edge portion, a left side edge portion, a first end portion, and a second end portion. The package comprises a second panel, wherein the second panel defines a right side edge portion, a left side edge portion, a first end portion, a second end portion. The first and second panels combine to define an interior and an exterior of the package. The package includes a pleat that interconnects between the first end portions of the first and second panels. The pleat defines a right side edge portion and a left side edge portion. The pleat comprises a handle aperture forming a handle. A first seam joins the right side edge portions of the first panel, the second panel, and the pleat. A second seam joins the left side edge portions of the first panel, the second panel, and the pleat. The second end portion of the first panel and the second end portion of the second panel combine to define an opening in the package. The first panel, the second panel, and the pleat are integrally formed.

Aspects of the present disclosure include a method of forming a package. The method comprises the steps of: advancing a continuous length of material in a machine direction, wherein the continuous length of material has a first side and a second side and defines a first edge region and a second edge region separated along a cross direction by a third region; forming first and second rows of intermittently spaced handle apertures in the machine direction along the central region of the continuous length of material; folding the continuous length of material in the cross direction along the central region of the continuous length of material to bring the first edge region of the second side of the continuous length of material into a face-to-face relationship with the central region of the second side of the continuous length of material, wherein the handle apertures in the first row of handle apertures are aligned with the handle apertures in the second row of handle apertures; forming a continuous seam along the machine direction proximate to the first and second rows of intermittently spaced handle apertures to define a continuous pleat, wherein the first and second rows of handle apertures are positioned between the continuous fold and the continuous seam, wherein the continuous pleat defines a first pleated portion and a second pleated portion, wherein the first pleated portion comprises the first row of handle apertures and the second pleated portion comprises the second row of handle apertures; cutting the continuous length of material in the cross direction to form a discrete package, wherein the discrete package comprises a first panel and a second panel, wherein the first and second panels each define a right side edge portion, a left side edge portion, a first end portion, and second end portion; and a pleat that interconnects between the first end portions of the first and second panels, wherein the pleat defines a right side edge portion and a left side edge portion, wherein the pleat comprises a handle aperture forming a handle; forming a first seam that joins the right side edge portions of the first panel, the second panel, and the pleat; and forming a second seam that joins the left side edge portions of the first panel, the second panel, and the pleat, wherein the second end portions of the first and second panels combine to define an opening in the package.

DETAILED DESCRIPTION

Figure 1:
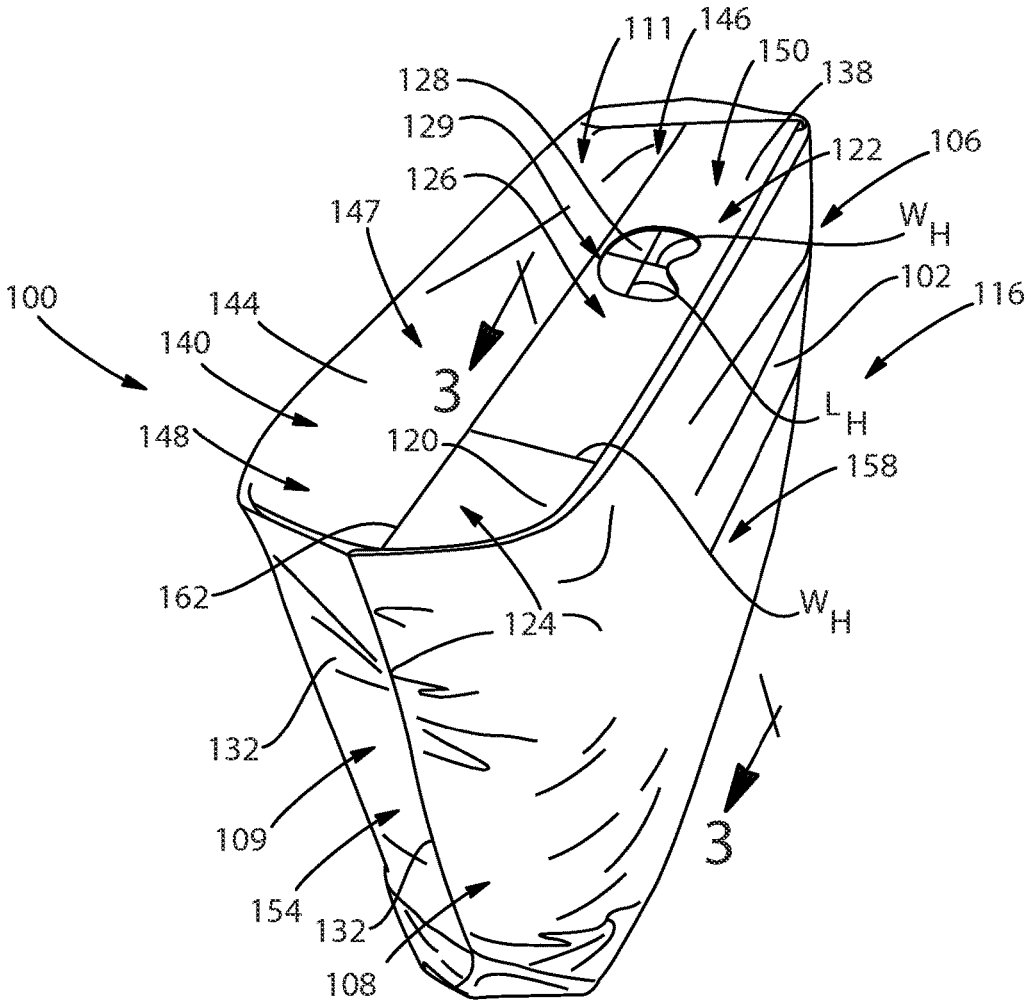
FIG. 1 is a front, perspective view of a package having an integrated handle.

The following definitions may be useful in understanding the present disclosure.

"Absorbent article" is used herein to refer to consumer products whose primary function is to absorb and retain soils and wastes. "Diaper" is used herein to refer to an absorbent article generally worn by infants and incontinent persons about the lower torso. The term "disposable" is used herein to describe absorbent articles which generally are not intended to be laundered or otherwise restored or reused as an absorbent article (for example, they are intended to be discarded after a single use and may also be configured to be recycled, composted or otherwise disposed of in an environmentally compatible manner).

"Longitudinal" means a direction running substantially perpendicular from a waist edge to a longitudinally opposing waist edge of an absorbent article when the article is in a flat out, uncontracted state, or from a waist edge to the bottom of the crotch, i.e. the fold line, in a bi-folded article. Directions within 45 degrees of the longitudinal direction are considered to be "longitudinal." "Lateral" refers to a direction running from a longitudinally extending side edge to a laterally opposing longitudinally extending side edge of an article and generally at a right angle to the longitudinal direction. Directions within 45 degrees of the lateral direction are considered to be "lateral."

"Machine direction" (MD) is used herein to refer to the direction of material flow through a process. In addition, relative placement and movement of material can be described as flowing in the machine direction through a process from upstream in the process to downstream in the process. "Cross direction" (CD) is used herein to refer to a direction that is not parallel with, and usually perpendicular to, the machine direction.

The present disclosure relates to packages for containing absorbent articles, and more particularly, relates to packages comprising integrally formed handles and methods of making the same. Packages of the present disclosure may include a first panel and a second panel. The first and second panels each define a right side edge portion, a left side edge portion, a first end portion, and a second end portion. The package may comprise a pleat that interconnects between the first end portions of the first and second panels. The pleat defines a right side edge portion and a left side edge portion separated by a central portion. The pleat may comprise a handle aperture in the central portion that forms a handle for the package. The first panel, the second panel, and the pleat combine to define an interior and an exterior of the package. A first seam joins the right side edge portions of the first panel, the second panel, and the pleat and a second seam joins the left side edge portions of the first panel, the second panel, and the pleat. A third seam joins the second end portion of the first panel with the second end portion of the second panel. The first panel, the second panel, and the pleat are integrally formed.

Packages of the present disclosure may be configured as reclosable wicketed bags. The wicketed bag may include a first panel and a second panel. The first and second panels each define a right side edge portion, a left side edge portion, a first end portion, and a second end portion. Wicketed bag may include a wicket panel connected with the second end portion of the second panel. The wicket panel may comprise a wicket aperture. The wicketed bag may also include a pleat that interconnects between the first end portions of the first and second panels. The pleat defines a right side edge portion and a left side edge portion separated by a central portion. The pleat may comprise a handle in the central portion that forms a handle for the package. The first panel, second panel, and the pleat combine to define an interior and an exterior of the package. A first seam joins the right side edge portions of the first panel, the second panel, and the pleat and a second seam joins the left side edge portions of the first panel, the second panel, and the pleat. The second end portion of the first panel and the second end portion of the second panel combine to define an opening in the package. The first panel, the second panel, the wicket panel, and the pleat are integrally formed.

The present disclosure includes a method of forming a wicketed bag. The method may comprise the step of advancing a continuous length of material in a machine direction, wherein the continuous length of material defining a first edge region and a second edge region separated along a cross direction by a third region. A line of weakness may be formed along the machine direction of the central region of the continuous length of material. First and second rows of intermittently spaced handle apertures may be formed in the machine direction along the central region of the continuous length of material. The second row of handle apertures may be positioned between the first row of handle apertures and the line of weakness. Intermittently spaced wicket apertures may be formed in the machine direction along the second edge region of the continuous length of material. The continuous length of material may be folded in the cross direction along the central region of the continuous length of material to bring the first edge region of the second side of the continuous length of material into a face-to-face relationship with the central region of the second side of the continuous length of material. The method may include folding the continuous length of material to form a continuous pleat. The continuous pleat comprises a first handle aperture from the first row of handle apertures and a second handle aperture from the second row of handle apertures, wherein the first and second handle apertures are aligned to form a handle. The continuous length of material may be folded to form a first continuous gusset panel interconnected between the first continuous panel and the continuous pleat and a second continuous gusset panel interconnected between the continuous pleat and the second continuous panel.

The continuous length of material may be cut in the cross direction to form a discrete package. A first seam may be formed to join the right side edge portions of the first panel, the second panel, and the pleat. A second seam may be formed to join the left side edge portions of the first panel, the second panel, and the pleat. The discrete package may be filled with a plurality of absorbent articles by inserting the absorbent articles into the opening in the package. Next, a third seam may be formed to join the bottom edge portions of the first and second panels. The step of joining the bottom edge portions of the first and second panels may comprise removing the wicket panel from the second panel.

Absorbent articles of the present disclosure may include diapers, feminine pads, adult incontinence products, and the like.

Figure 2:
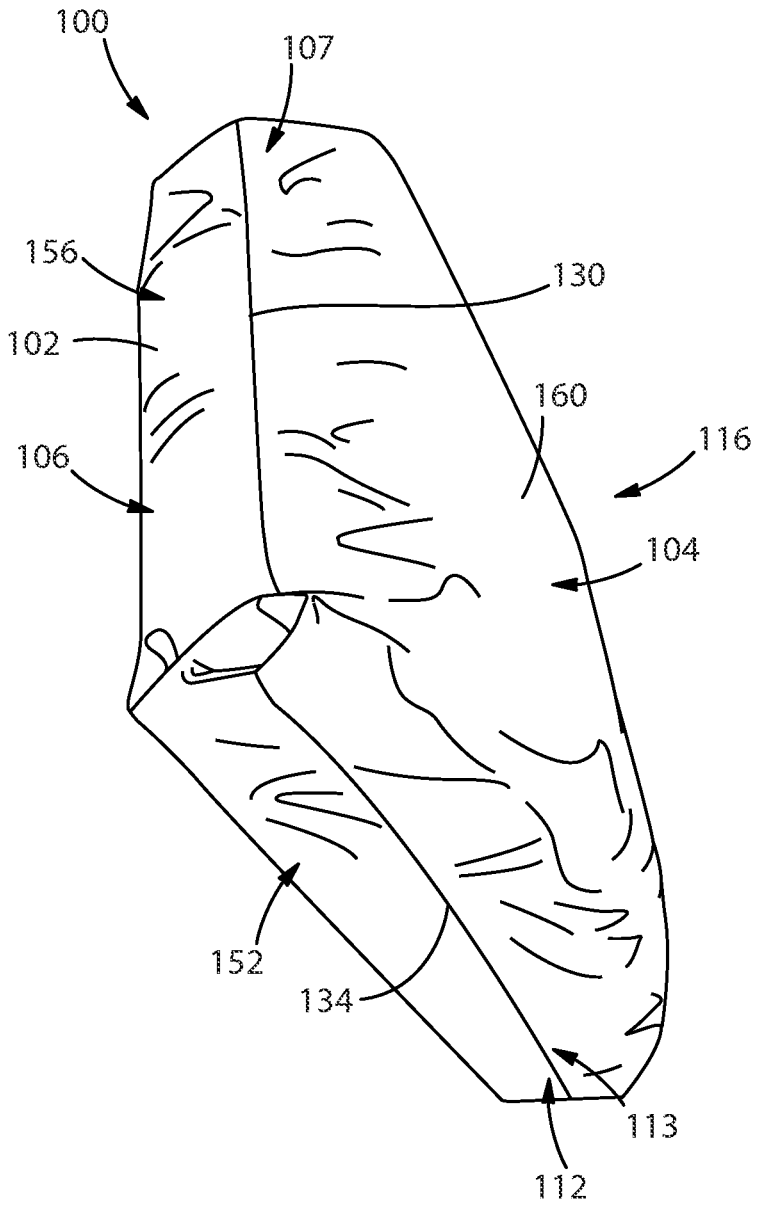
FIG. 2 is a back, perspective view of a package having an integrated handle.
Figure 3:
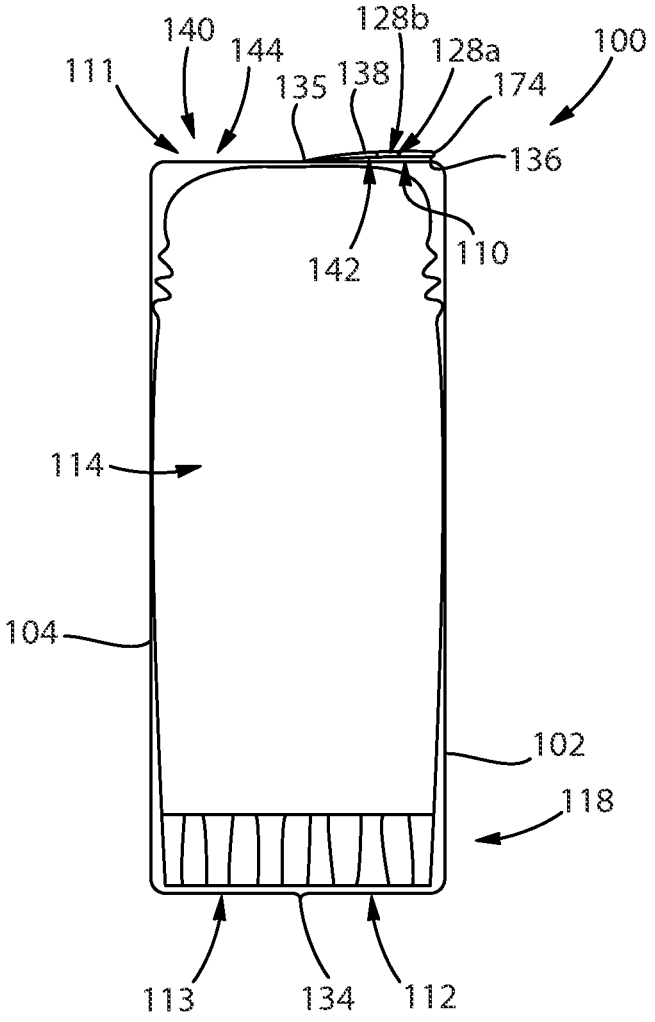
FIG. 3 is a sectional view of the package of FIG. 1 taken along line 3-3.

As shown in FIGS. 1-3, an exemplary package 100 for containing absorbent articles 200 may include a first panel 102 and a second panel 104. The first and second panels 102 and 104 may each define a right side edge portion 106 and 107, a left side edge portion 108 and 109, a first end portion 110 and 111, and a second end portion 112 and 113, respectively. The package 100 may include a pleat 120 that interconnects between the first end portions 110 and 111 of the first and second panels 102 and 104. The pleat 120 defines a right side edge portion 122 and a left side edge portion 124 separated by a central portion 126. The pleat 120 may include a handle aperture 128 in the central portion 126 that forms a handle 129 for the package 100. The right side edge portions 106, 107, and 122 of the first panel 102, the second panel 104, and the pleat 120, respectively, may be joined along a first seam 130 and the left side edge portions 108, 109, and 124 of the first panel 102, the second panel 104, and the pleat 120, respectively, may be joined along a second seam 132. A third seam 134 may join the second end portion 112 of the first panel 102 with the second end portion 113 of the second panel 104. A fourth seam 135 may connect the pleat 120 with the first end portions 110 and 111 of the first and second panels 102 and 104. The first panel 102, the second panel 104, and the pleat 120 combine to define an interior 114 and an exterior 116 of the package 100. The first panel 102, the second panel 104, and the pleat 120 may be integrally formed.

As shown in FIGS. 1 and 3, the package may include a gusset 140 having a first gusset panel 142 and a second gusset panel 144. In some exemplary configurations, the first gusset panel 142 may interconnect between the pleat 120 and the first end portion 110 of the first panel 102 and the second gusset panel 144 may interconnect between the pleat 120 and the first end portion 111 of the second panel 104.

Figure 4A:
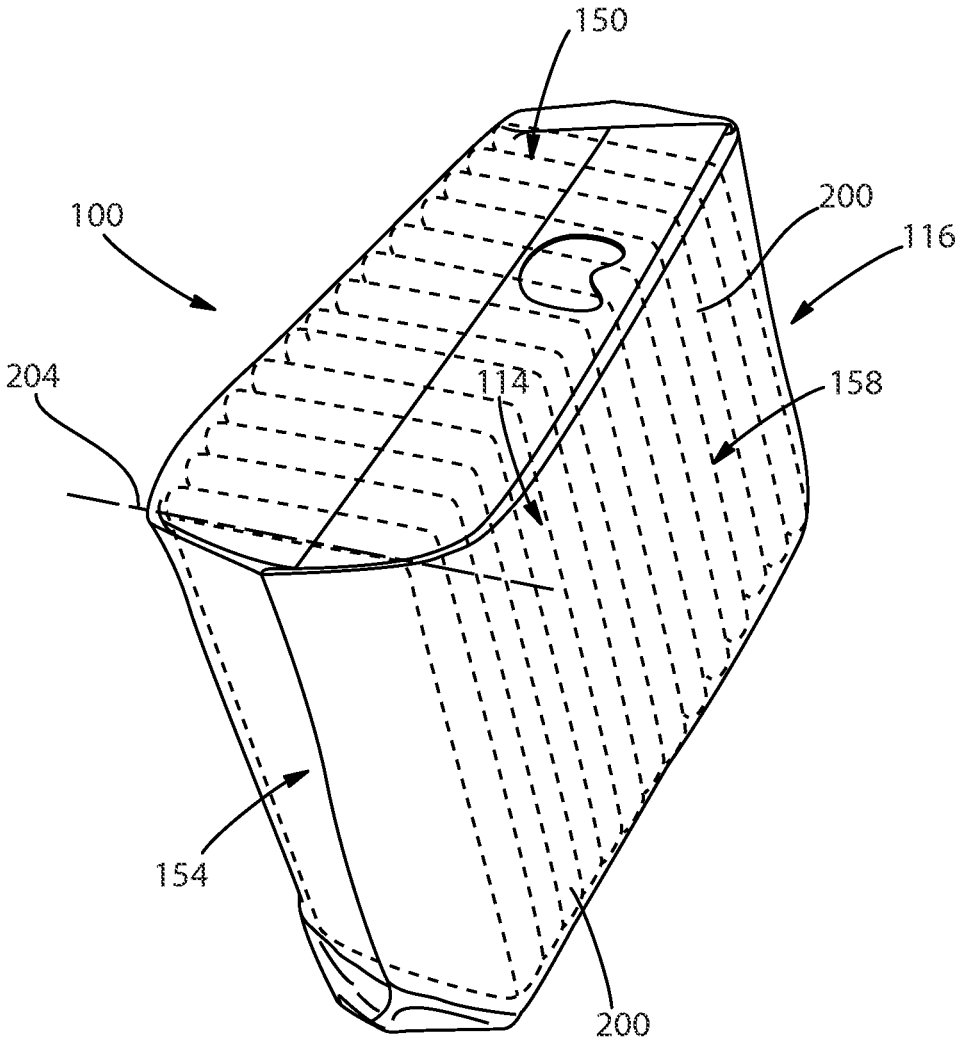
FIG. 4A is a front, perspective view of a package having an integrated handle and having absorbent articles contained therein.
Figure 4B:
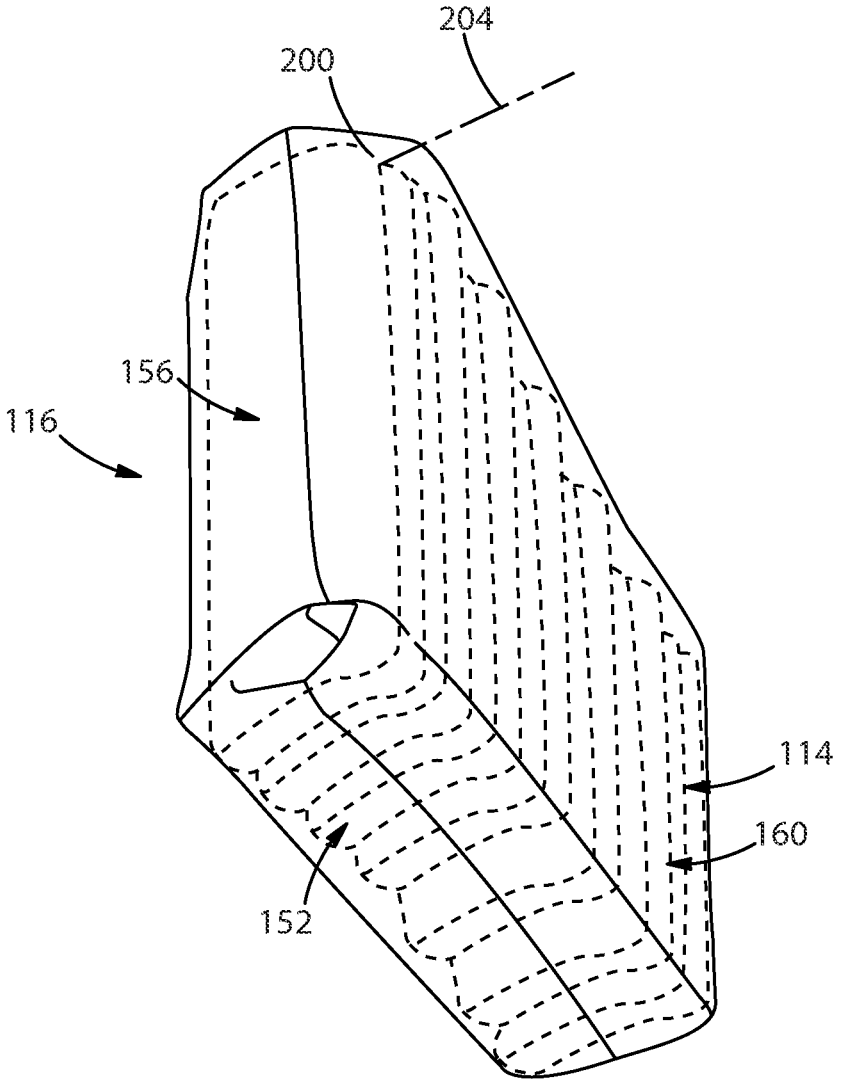
FIG. 4B is a back, perspective view of a package having an integrated handle and having absorbent articles contained therein.

The package may contain a plurality of absorbent articles. As shown in FIGS. 4A and 4B, each absorbent article 200 may be folded about a lateral axis 204 and arranged in a horizontal or vertical row or rows. Placement of the row or rows of absorbent articles 200 into the interior 114 of the package 100 forms a substantially hexahedral shaped package 100 having a top panel 150, a bottom panel 152, a front panel 158, a back panel 160, a left side panel 154, and a right side panel 156. With reference to FIGS. 1-4B, in some exemplary configurations, the pleat 120 and the first and second gusset panels 142 and 144 define the top panel 150 of the package 100. In such an exemplary configuration, the first panel 102 may define the front panel 158 of the package 100 and the second panel 104 may define the back panel 160 of the package 100. The left edge portions 108 and 109 of the first and second panels 102 and 104 define a left side panel 154 and the right edge portions 106 and 107 of the first and second panels 102 and 104 define a right side panel 156. The second end portions 112 and 113 of the first and second panels 102 and 104 may define the bottom panel 152 of the package 100.

With reference to FIGS. 1-3, the package 100 may be configured such that the bottom panel 152 may be supported by a surface such as a table, countertop, floor, changing table, and the like. However, it is to be appreciated that the package 100 may be configured to rest on any of the top panel 150, bottom panel 152, front panel 158, back panel 160, left side panel 154, or right side panel 156. Further, while it is shown that the pleat 120 and the first and second gusset panels 142 and 144 form the top panel 150 of the package 100, it is to be appreciated that the pleat 120 may be positioned in various other configurations such that the pleat 120 may define a portion of another panel of the package 100. For example, in some exemplary configurations, the pleat 120 may define a portion of the front panel 158, back panel 160, or bottom panel 152 of the package 100.

As described above, the package 100 may comprise a pleat. As shown in FIGS. 1 and 3, the pleat 120 may define a first pleated portion 136 and a second pleated portion 138 connected at a first fold 174. The first fold 174 may be configured in a C-shape. The first and second pleated portions 136 and 138 may each comprise a handle aperture 128*a* and 128*b*. As shown in FIG. 1, in some exemplary configurations the handle apertures 128 may be positioned in the central portion 126 of the pleat 120. The first pleated portion 136 may be positioned between the first gusset panel 142 and the second pleated portion 138. The first and second pleated portions 136 and 138 and handle apertures 128*a* and 128*b* combine to form an integrally formed handle 129 to the package 100. In some exemplary configurations, the package 100 may comprise one or more pleats 120. The handle apertures 128 may be configured to be larger than at least two fingers of a human hand. As a result, a user may insert two or more fingers of a hand through the handle apertures 128 to carry the package 100. In some exemplary configurations, the handle aperture 128 may have a length $L_H$ in the range of about 40 millimeters to about 150 millimeters, or about 50 millimeters to about 100 millimeters, for example. In some exemplary configurations, the handle aperture may have a width $W_H$ in the range of about 10 millimeters to about 50 millimeters, or about 20 millimeters to about 40 millimeters, for example. It is to be appreciated that the handle apertures 128 may have various dimensions. It is to be appreciated that the handle apertures 128 may have various shapes such as rectangles, circles, and ovals for example. The first and second pleated portions 136 and 138 may have a width $W_P$ in the range of about 20 millimeters to about 50 millimeters, for example. It is to be appreciated that the handle may have various dimensions.

The package may include one or more expandable gussets. As shown in FIGS. 1-3, the top panel 150 of the package 100 may comprise a gusset 140 having a first gusset panel 142 and a second gusset panel 144. As shown in FIGS. 1 and 3, in some exemplary configurations, the pleat 120 may be interconnected between the first and second gusset panels 142 and 144. The gusset 140 may define a right side edge portion 146 and a left side edge portion 148 separated by a central portion 147. The gusset 140 may extend from the first seam 130 to the second seam 132. The right side edge portion 146 of the gusset 140 may be joined with the right side edge portions 122, 106, and 107 of the pleat 120 and the first and second panels 102 and 104, respectively, at the first seam 130 and the left side edge portion 148 of the gusset 140 may be joined with the left side edge portions 124, 108, and 109 of the pleat 120 and the first and second panels 102 and 104, respectively, at the second seam 132.

With continuing reference to FIGS. 1 and 3, as a package 100 is filled with absorbent articles 200, the first and second gusset panels 142 and 144 may each become folded and tucked in toward the interior 114 of the package 100 at the right and left side edge portions 146 and 148 of the gusset 140. As a result, the package 100 may conform to the shape of the row or rows of absorbent articles 200 to prevent movement and/or distortion of the absorbent articles 200 during packing, shipping, and use by a consumer. The gusset 140 may be integrally formed with the first panel 102, the second panel 104, and the pleat 120. In an exemplary configuration shown in FIGS. 1 and 3, the gusset 140 and the pleat 120 may define the top panel 150 of the package 100. While it is shown in FIGS. 1 and 3 that the gusset 140 defines a portion of the top panel 150 of the package 100, it is to be appreciated that various other panels of the package 100 may also comprise gussets. For example, the right side edge portions 106 and 107 of the first and second panels 102 and 104, the left side edge portions 108 and 109 of the first and second panels 102 and 104, and/or the second end portions 112 and 113 of the first and second panels 102 and 104 may comprise gussets. In some exemplary configurations, the package 100 may include one or more gussets 140.

The gusset 140 shown in FIG. 1 allows the pleat 120 to lay substantially flat while the handle 129 is unengaged by a user. This may provide various benefits for a user. For example, as a result of the handle 129 being integrally formed with the first and second panels 102 and 104, the handle 129 does not obstruct access to the package 100 or hinder normal use of the package 100. Moreover, the integrated handle 129 may be perceived as being more durable than a handle that is attached to a package as a separate component. Additionally, the package 100 may be aesthetically pleasing to consumers as the package 100 has a continuous profile without additional parts or elements extending outward from the exterior of the package 100 when the package 100 is not in use. Additionally, the pleat 120 remains flat and substantially free of wrinkles or folds. The handle apertures 128 also remain in substantially the same location, which may allow the user to easily locate the handle 129 from one use to the next.

As shown in FIG. 1, the package 100 may comprise a line of weakness 162. The line of weakness 162 may be broken by a user to gain access to the interior 114 of the package 100. The line of weakness 162 may be positioned in various locations. The line of weakness 162 may extend from the first seam 130 to the second seam 132. As shown in FIG. 1, in some exemplary configurations, the line of weakness 162 may connect the pleat 120 with the second gusset panel 104. In other exemplary configurations, the line of weakness 162 may be positioned in various other locations, including the front panel 158, back panel 160, right or left side panels 156 and 154, or the bottom panel 152. The line of weakness 162 may extend through one or more panels of the package 100. In some exemplary configurations, the package 100 may include more than one line of weakness 162. As a result, the package 100 may be opened in more than one location. The line of weakness 162 may comprise perforations. The line of weakness 162 may be formed by perforation, crimping, or various other means, to provide a line that is weaker in structure as compared to the portions of package 100 adjacent to the line of weakness 162. It is to be appreciated that the line of weakness 162 may be strong enough to withstand shipping and handling of the package 100, while being weak enough for a consumer to open the package 100 at the time of first use of the package 100. Prior to opening the package 100 at the line of weakness 162, the package 100 may be sealed. Thus, the package 100 may be prevented from tampering or contamination until the consumer opens the package 100 to remove an absorbent article. That is, during shipping, storage, and while at the store, the package 100 may remain sealed. In some exemplary configurations, the package 100 may be substantially hermetically sealed. For example, the line of weakness 162 may be substantially linear, or, in other exemplary configurations, the line of weakness may be curved.

A package 100 of the present disclosure may comprise various materials. For example, the package may comprise films made from materials such as polyethylene or polypropylene, for example. In some exemplary configurations, package comprises a polyethylene-polypropylene-polyethylene laminate. In those exemplary configurations where the package comprises a laminate, the laminate may be co-extruded. The package may have a thickness from about 35 microns to about 50 microns, or from about 40 to about 45 microns. In an exemplary configuration where a thicker package is desired, the package may have a thickness from about 55 microns to about 65 microns.

In some exemplary configurations, components of the package can at least partially be comprised of bio-sourced content such as described in US 2007/0219521A1 Hird et al published on Sep. 20, 2007, US 2011/0139658A1 Hird et al published on Jun. 16, 2011, US 2011/0139657A1 Hird et al published on Jun. 16, 2011, US 2011/0152812A1 Hird et al published on Jun. 23, 2011, US 2011/0139662A1 Hird et al published on Jun. 16, 2011, and US 2011/0139659A1 Hird et al published on Jun. 16, 2011.

In at least one exemplary configuration, a package comprises a bio-based content value from about 10% to about 100% using ASTM D6866-10, method B, in another exemplary configuration, from about 25% to about 75%, and in yet another exemplary configuration, from about 50% to about 60% using ASTM D6866-10, method B.

In order to apply the methodology of ASTM D6866-10 to determine the bio-based content of any package, a representative sample of the package must be obtained for testing.

In at least one exemplary configuration, the package can be ground into particulates less than about 20 mesh using known grinding methods (e.g., Wiley® mill), and a representative sample of suitable mass taken from the randomly mixed particles.

In some exemplary configurations, the exterior of the package 100 may comprise various images, colors, text, and the like. With reference to FIG. 1, in some exemplary configurations, the package 100 may have indicia printed on the first and/or second panels 102 and 104 of the package 100, such that when the package 100 is placed with the bottom panel 152 facing down and the top panel 150 facing up, the indicia is oriented so that the indicia appears as upright. Such indicia may include words, e.g. brand name, size, product line, advertising, marketing claims, safety information, instructions for use, and the like, and/or graphics, e.g. pictures of users of the absorbent articles, caregivers, purchasers of the absorbent articles, advertising, and pictorial depictions of safety information and/or instructions for use, and the like.

To aid a consumer in locating line of weakness 162, it may be colored differently than the package. For example, with reference to FIG. 1, a package 100 may be clear and the line of weakness 162 may be colored, such as blue, or otherwise differentiated to draw attention to the line of weakness 162. In an exemplary configuration where one or more package 100 are placed in a secondary package, such as a cardboard box, the secondary package may be provided with indicia that draws attention to line of weakness, e.g. an arrow or "tear here" statement printed on the carton that corresponds to the position of line of weakness 162. In some exemplary configurations, the pleat 120 may comprise different colors or patterns than the remainder of the package. For example, in such an exemplary configuration, the pleat 120 may be clear while the remainder of the package 100 comprises a color and/or pattern of colors. In other exemplary configurations, the pleat 120 may be a different color than the remainder of the package 100. In addition, the package 100 may comprise indicia that draws attention to the pleat 120 of the package 100 and/or demonstrates how to use the handle 129. For example, an image may comprise a hand and a perspective view of the package and demonstrating a hand holding the package at the handle.

Figure 5:
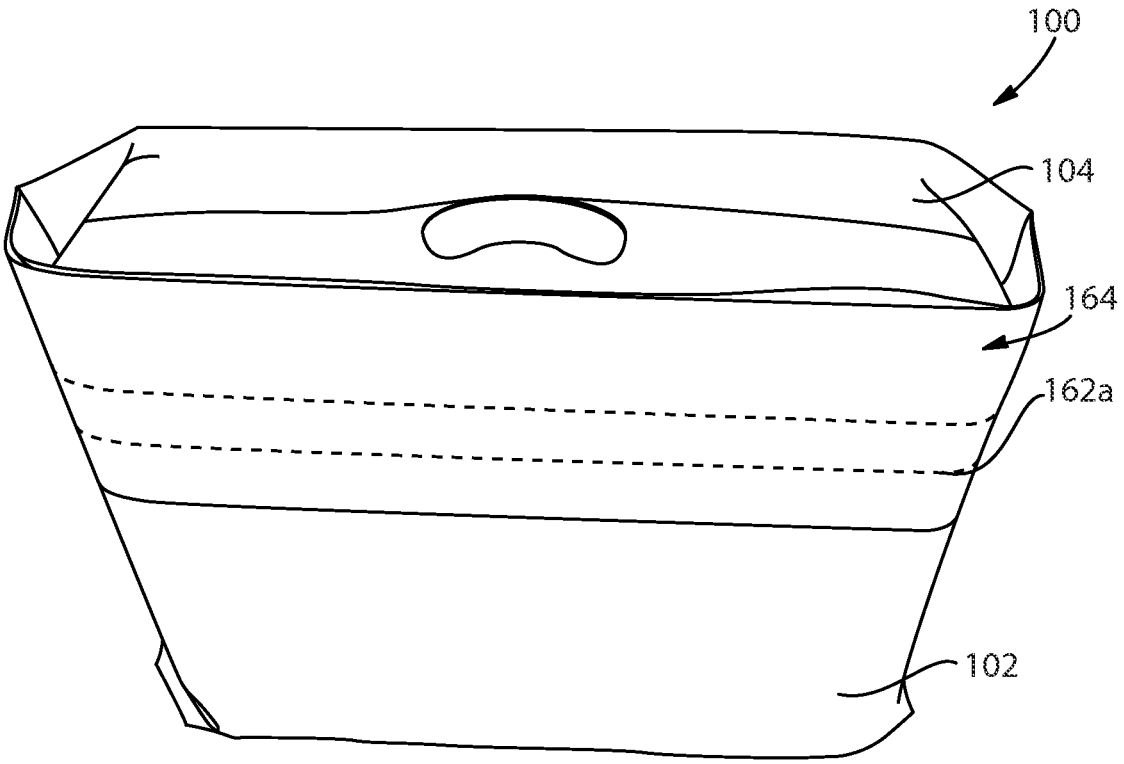
FIG. 5 is a front, perspective view of a reclosable package having an integrated handle and a hooded portion.
Figure 6:
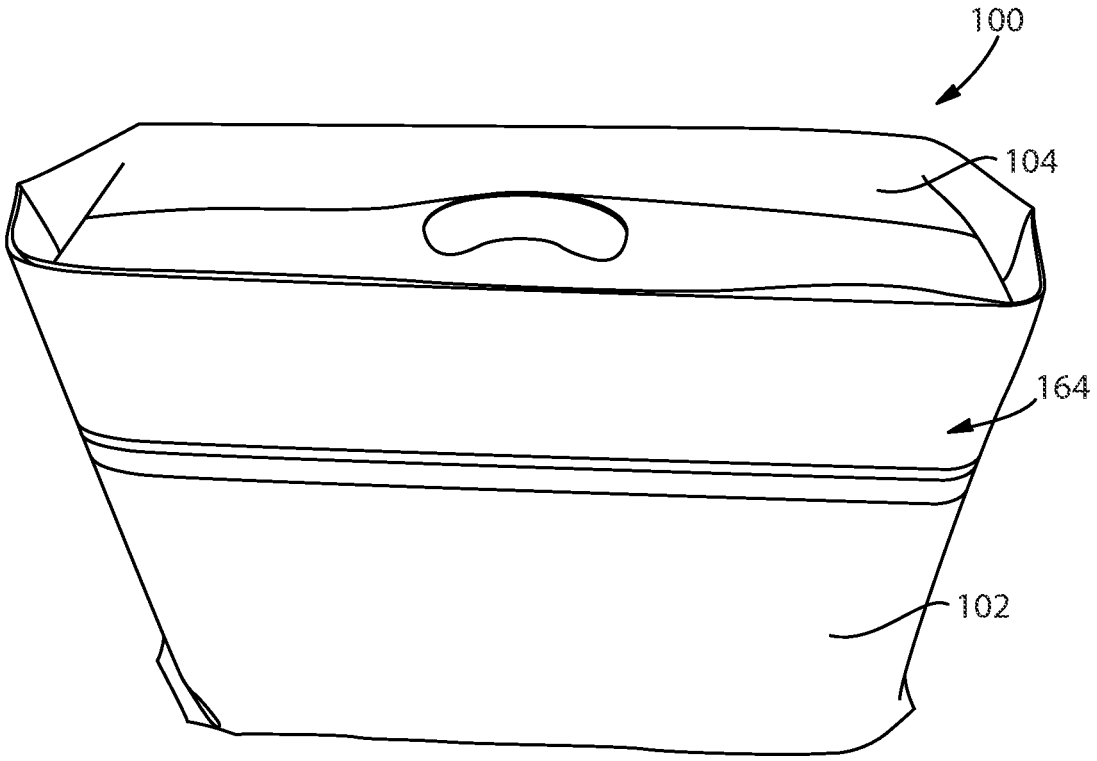
FIG. 6 is a front, perspective view of a reclosable package in a first configuration.
Figure 7:
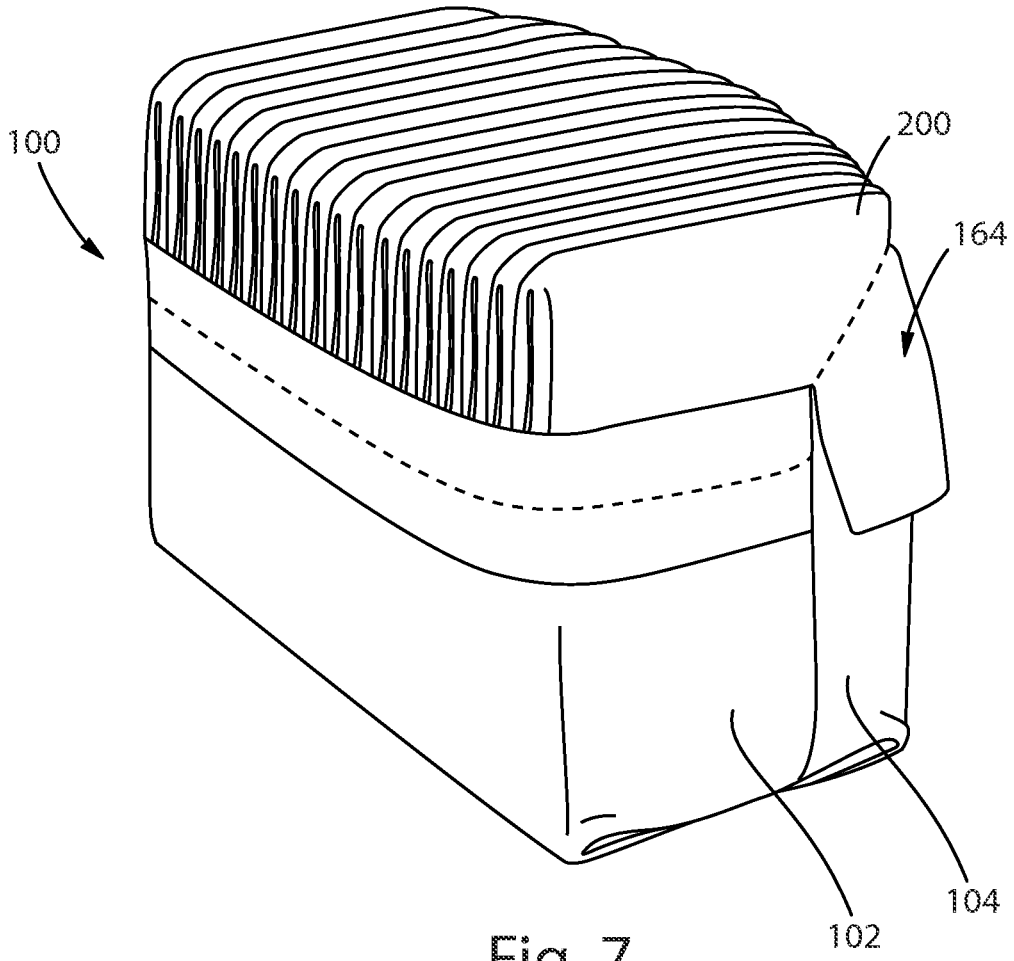
FIG. 7 is a front, perspective view of a reclosable package in a second configuration.

In some exemplary configurations, the package may be configured to be reclosable. For example, as shown in FIG. 5, the second panel 104 of the package 100 may comprise a hooded portion 164. A line of weakness 162*a* may connect the first and second panels 102 and 104. To open the package 100, the line of weakness 162*a* is broken. With the line of weakness 162*a* broken, the hooded portion 164 may be configured in a first, closed configuration, such as shown in FIG. 6 or a second, open configuration such as shown in FIG. 7. To arrange the package 100 in the second configuration, the hooded portion 164 is moved away from the first panel 102 to expose the absorbent articles 200 contained therein. To arrange the package 100 from the second configuration to the first configuration, the hooded portion 164 may be moved toward the first panel 102 to cover the absorbent articles that remain contained therein. Exemplary reclosable packages are described in U.S. patent application 13/899,798 titled "RECLOSABLE PACKAGE AND A METHOD OF MAKING THE SAME", filed May 22, 2013.

Figure 8A:
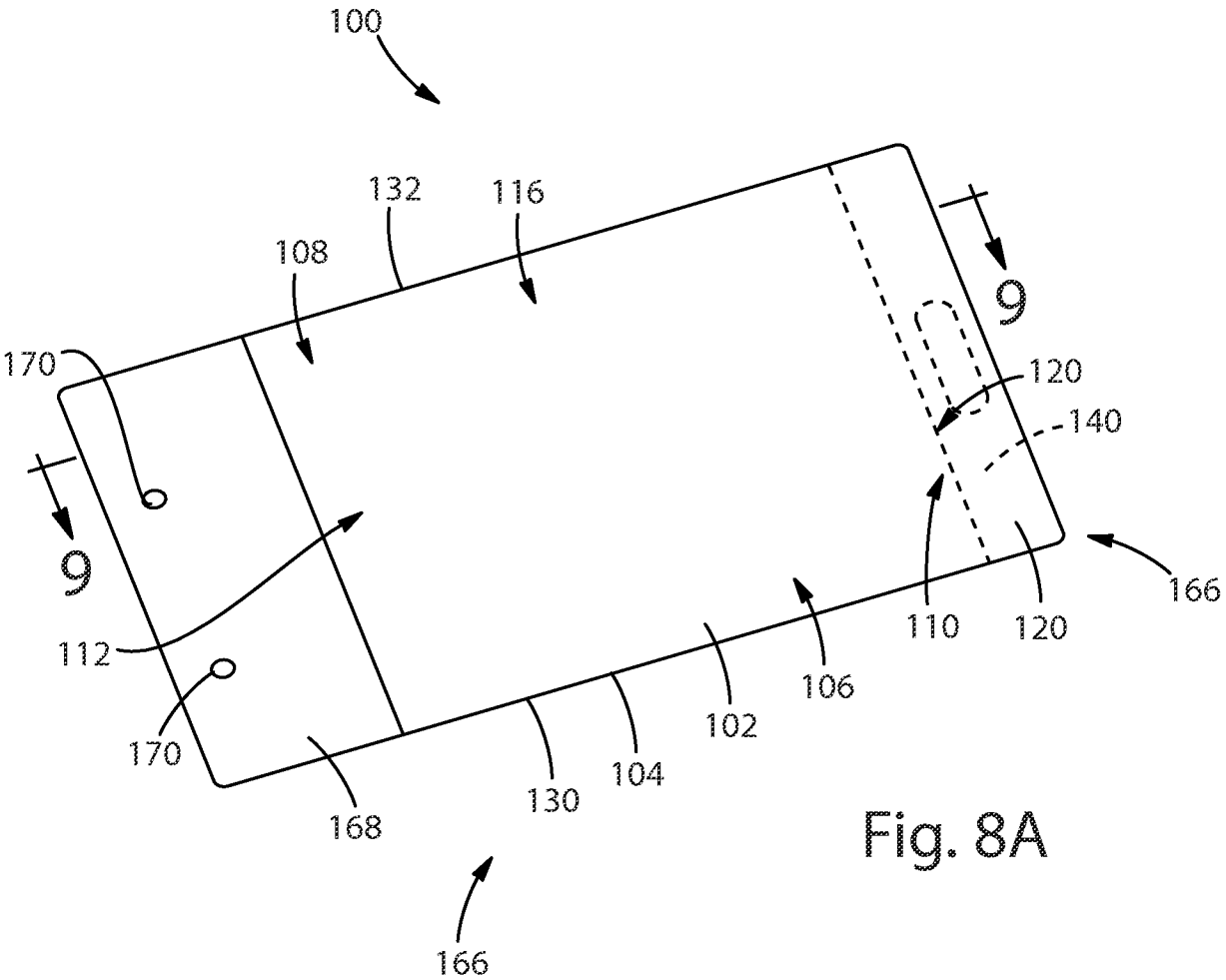
FIG. 8A is a top, perspective view of a wicketed bag.
Figure 8B:
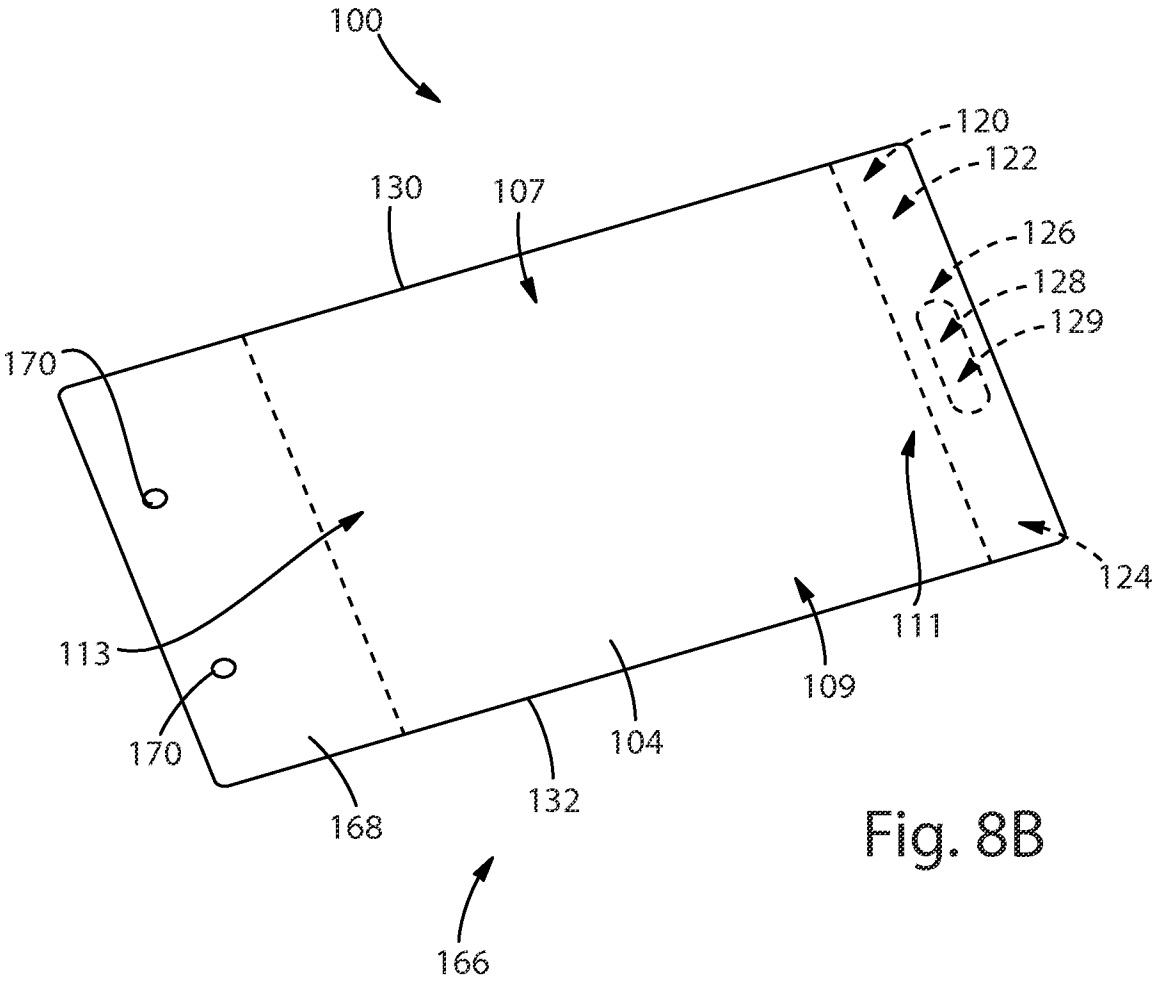
FIG. 8B is a bottom, perspective view of a wicketed bag.
Figure 9:
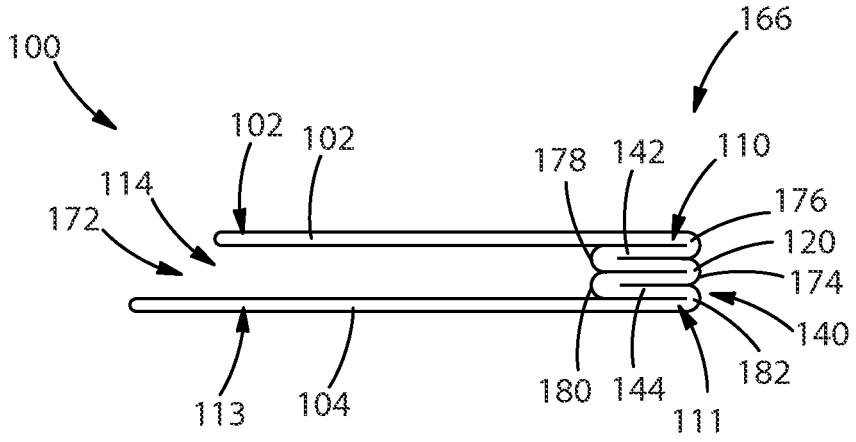
FIG. 9 is a sectional view of the wicketed bag of FIG. 8A taken alone line 9-9.

As shown in FIGS. 8A, 8B, and 9, prior to inserting absorbent articles into the package 100, the package 100 may be configured as a wicketed bag 166. The wicketed 166 bag may include a first panel 102 and a second panel 104. The first and second panels 102 and 104 each define a right side edge portion 106 and 107, a left side edge portion 108 and 109, a first end portion 110 and 111, and a second end portion 112 and 113. The wicketed bag 166 may include a wicket panel 168 connected with the second end portion 113 of the second panel 104. The wicket panel 168 may comprise a wicket aperture 170. The wicketed bag 166 may also include a pleat 120 that interconnects between the first end portions 110 and 111 of the first and second panels 102 and 104. The pleat 120 defines a right side edge portion 122 and a left side edge portion 124 separated by a central portion 126. The pleat 120 may comprise a handle aperture 128 in the central portion 126 that forms a handle 129 for the package 100. The first panel 102, second panel 104, and the pleat 120 combine to define an interior 114 and an exterior 116 of the package 100. A first seam 130 joins the right side edge portions 106, 107, and 122, respectively, of the first panel 102, the second panel 104, and the pleat 120 and a second seam 132 joins the left side edge portions 108, 109, and 124 of the first panel 102, the second panel 104, and the pleat 120. The second end portion 112 of the first panel 102 and the second end portion 113 of the second panel 104 combine to define an opening 172 in the package 100. The first panel 102, the second panel 104, the wicket panel 168, and the pleat 120 may be integrally formed. The wicket panel 168 comprises at least one wicket aperture 170. As shown in FIGS. 8A and 8B, the wicket panel 168 includes two wicket apertures 170. As discussed in more detail below, each wicket aperture 170 may be configured to receive a wicket. The wicket apertures 170 may be configured in various shapes. As shown in FIGS. 8A and 8B, the wicket apertures 170 may be substantially circular.

As discussed above, and as shown in FIGS. 8A, 8B, and 9, the wicketed bag 166 may comprise an expandable gusset 140. The gusset 140 may be integrally formed with the first panel 102, second panel 104, and the pleat 120. In an exemplary configuration shown in FIGS. 8A, 8B, and 9, the gusset 140 may include a first gusset panel 142 and a second gusset panel 144. The first gusset panel 142 may be connected with the first panel 102 at a second fold 176 and the first gusset panel 142 may be connected with the pleat 120 at a third fold 178. The second gusset panel 144 may be connected with the pleat 120 at a fourth fold 180 and the second gusset panel 144 may be connected with the second panel 104 at the fifth fold 182. The second, third, fourth, and fifth folds may be configured as C-shape folds.

Figure 10A:
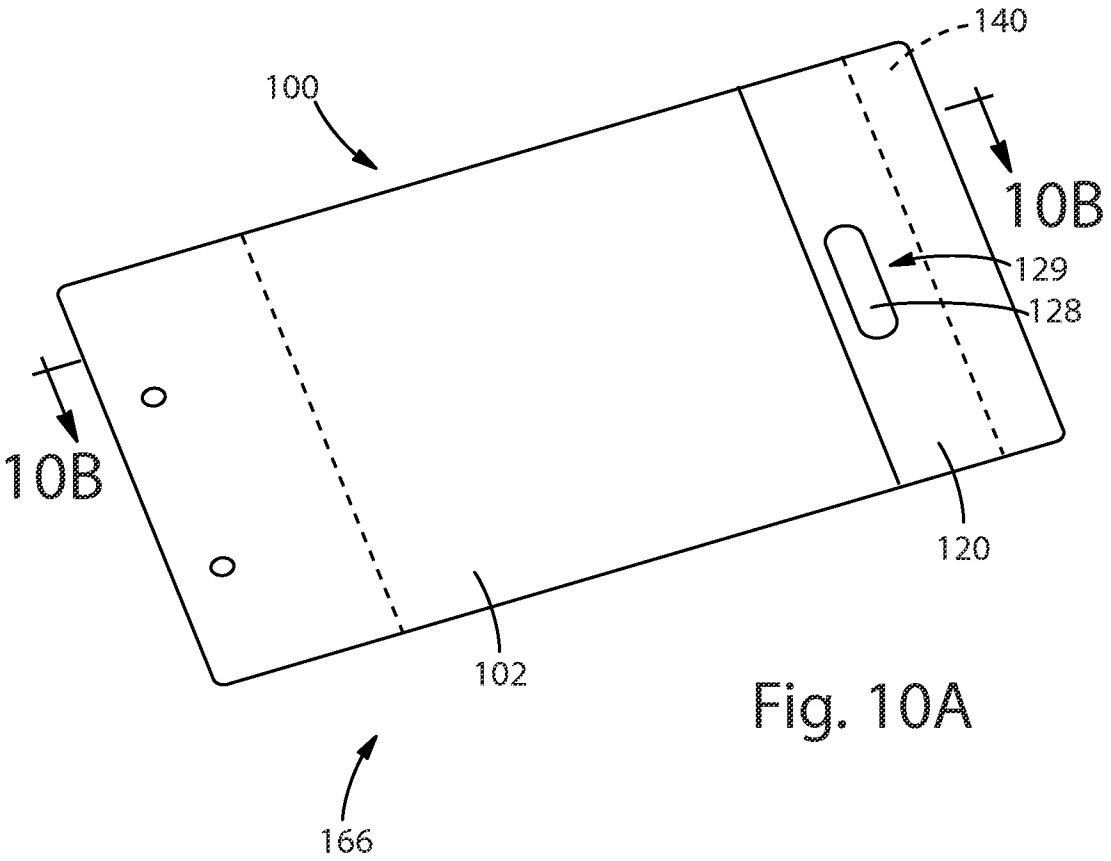
FIG. 10A is a top, perspective view of a wicketed bag.
Figure 10B:
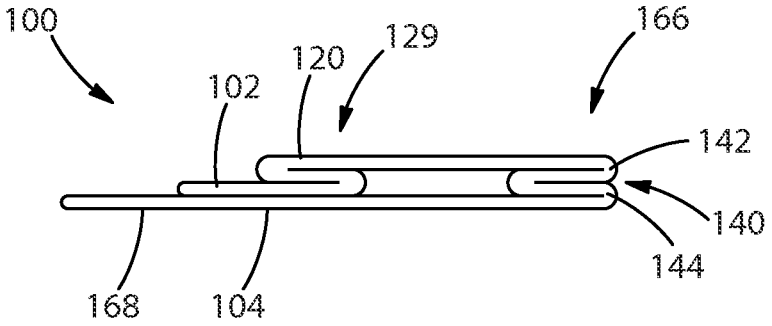
FIG. 10B sectional view of the wicketed bag of FIG. 10A taken alone line 10B-10B.

As shown in FIGS. 10A and 10B, in some exemplary configurations, the pleat 120 may be positioned away from the gusset 140. With reference to FIGS. 1 and 3, it is to be appreciated that in such an exemplary configuration, the pleat 120 may define a portion of the front panel 158 of the package 100 and the gusset 140 may define the top panel 150 of the package 100. It is to be appreciated that the pleat 120 may be configured in various locations on the package 100 depending upon the desired location of the handle 129.

Figure 11:
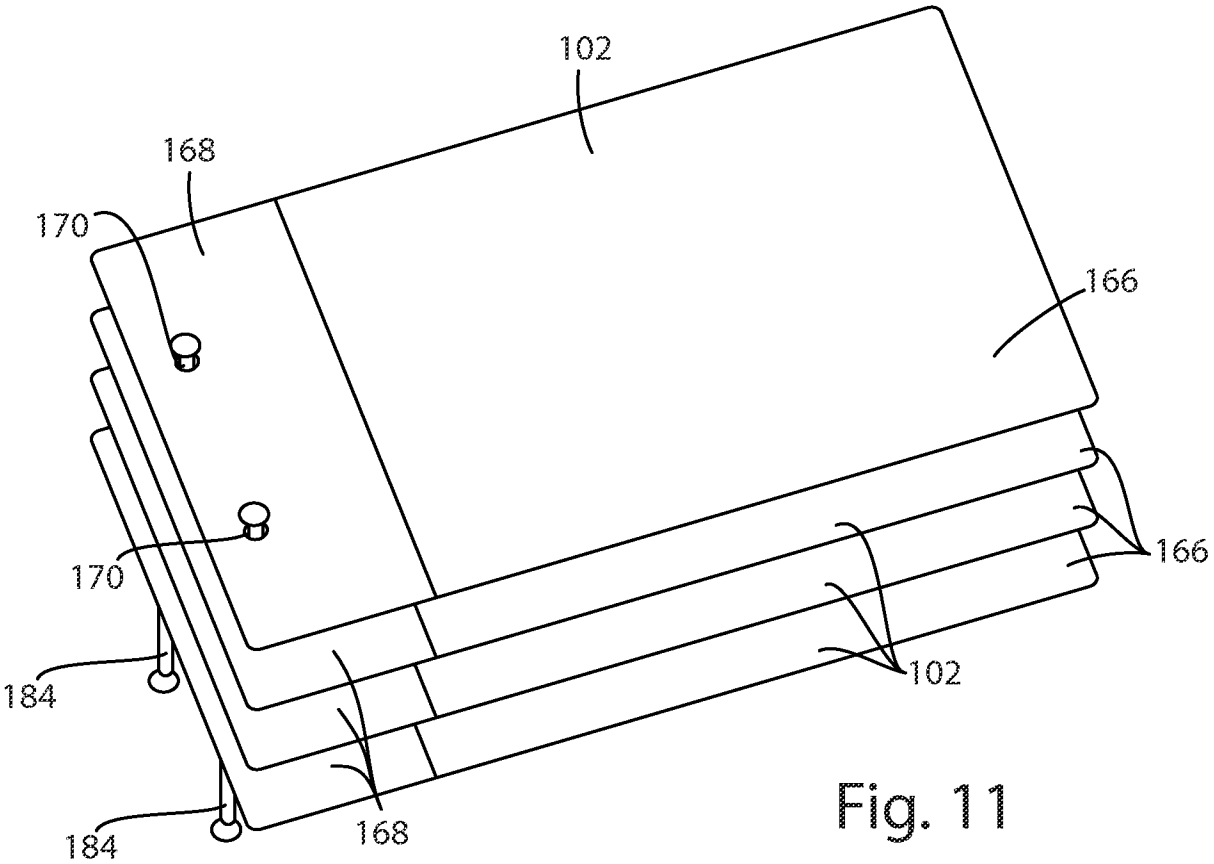
FIG. 11 is a perspective view of a stack of wicketed bags held together by two wickets.

As shown in FIG. 11, a plurality of wicketed bags 166 may be stacked on top of each other such that the wicket apertures 170 of each wicketed bag 166 are aligned. A wicket 184 may extend through the wicket apertures 170 to hold the stack of bags together. In an exemplary configuration wherein wicketed bags 166 in a stack each comprise two wicket apertures 170, two wickets 184 may be used. Various types of wickets 184 for holding a stack of wicketed bags 166 together may be used. As discussed in more detail below, the plurality of wicketed bags are held together by the wickets while the absorbent articles are introduced into the wicketed bag through the opening. Once the bag is filled with absorbent articles, the first and second panels may be sealed together at a third seam and the wicketed portion may cut from the second panel.

Figure 12:
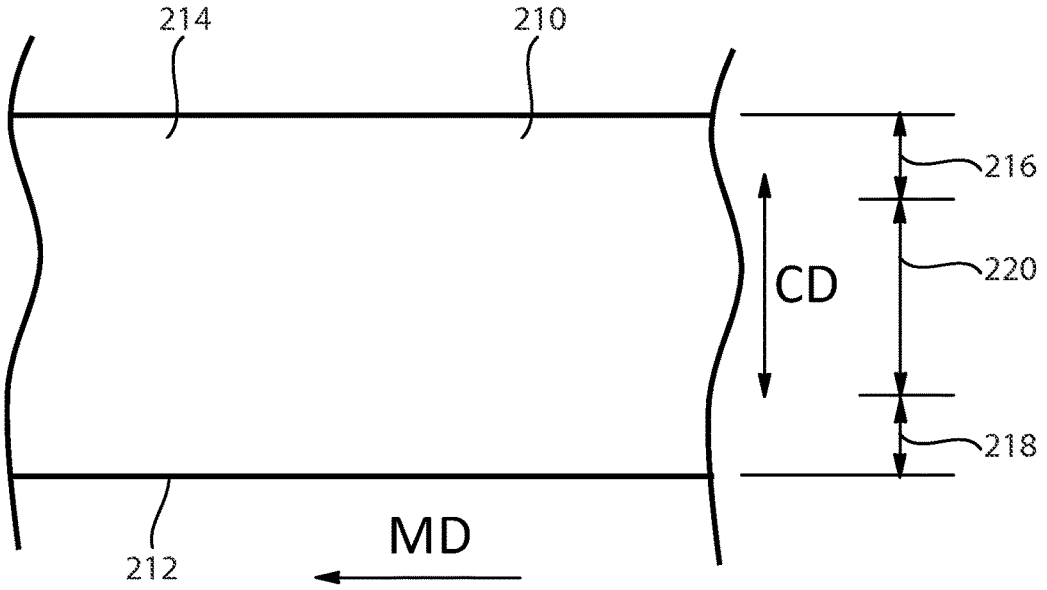
FIG. 12 is a schematic, plan view of a continuous length of material.

A reclosable wicketed bag may be formed from a single continuous length of material. As shown in FIG. 12, a method of making a wicketed bag may include advancing a continuous length of material 210 in a machine direction MD. The continuous length of material 210 has a first side 212 and an opposing second side 214 and may be define a first edge region 216 and an opposing second edge region 218 separated along a cross direction CD by a central region 220. The continuous length of material may comprise a thermoplastic film, such as a polyethylene or polypropylene film, for example.

Figure 13:
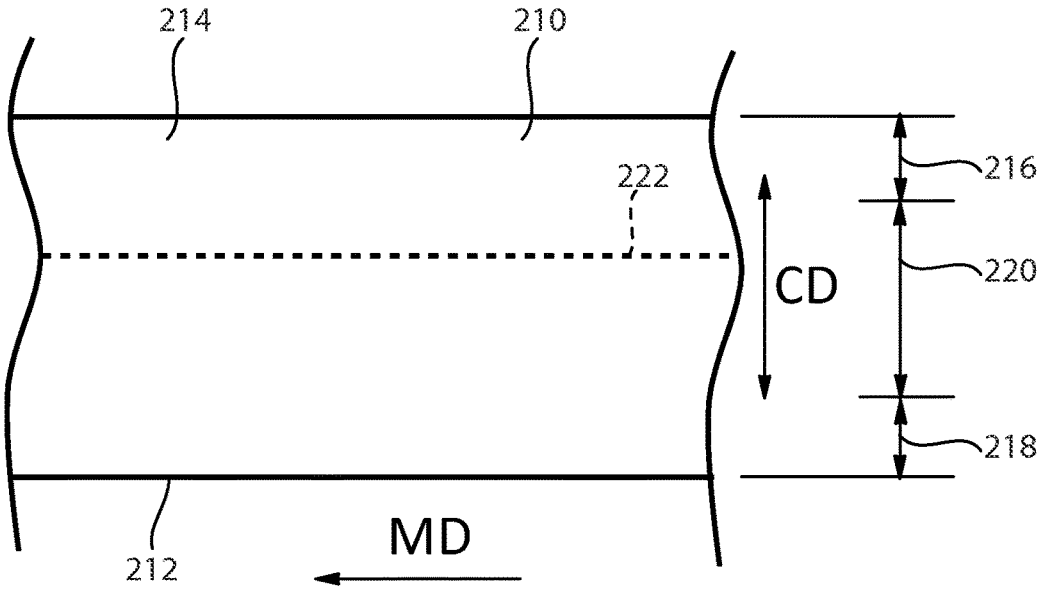
FIG. 13 is a schematic, plan view of a continuous length of material having a continuous line of weakness.

The continuous length of material 210 may be subjected to various operations while advancing in the machine direction MD. For example, as shown in FIG. 13, a continuous line of weakness 222 may be formed in the continuous length of material 210. The line of weakness 222 may extend along the machine direction MD and may be positioned in various cross directional CD locations. As shown in FIG. 13, in some exemplary configurations, the line of weakness 222 may extend in the machine direction MD along the central region 220 of the continuous length of material 210. The line of weakness 222 may be formed in various ways, such as by perforating, crimping, embossing, and the like to provide a line that is weaker in structure as compared to the other portions of package. The line of weakness 222 may be configured in various ways. For example, the line of weakness 222 may be substantially linear, or, in other exemplary configurations, the line of weakness may be curved.

Figure 14:
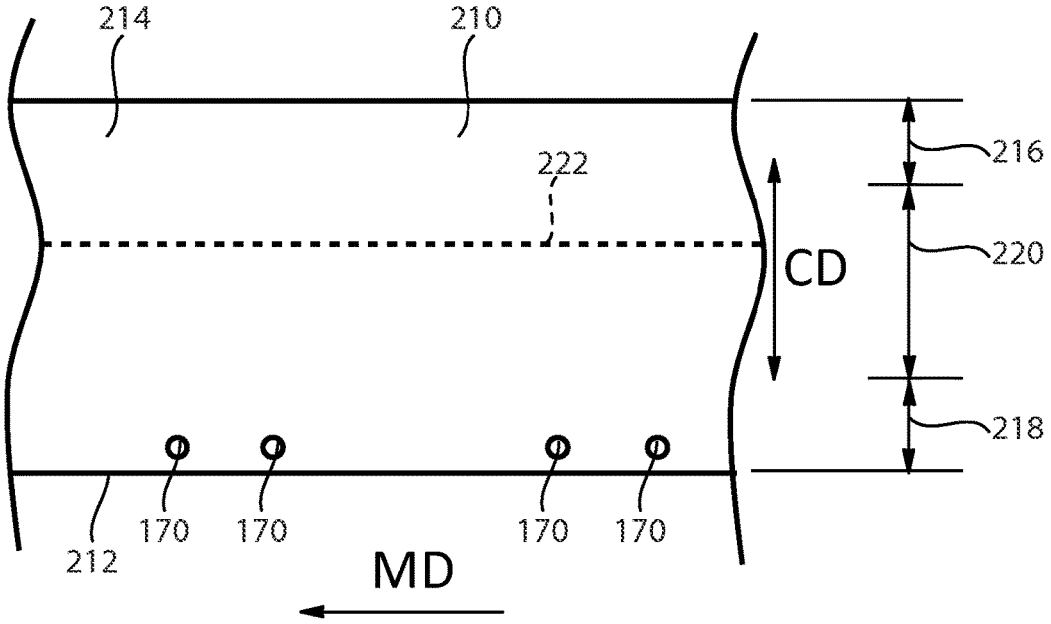
FIG. 14 is a schematic, plan view of a continuous length of material having a continuous line of weakness and a plurality of intermittently spaced wicket apertures.

As shown in FIG. 14, in another step, intermittently spaced wicket apertures 170 may be formed in the continuous length of material 210 along the machine direction MD. The wicket apertures 170 may be positioned in various cross directional CD locations of the continuous length of material 210. In some exemplary configurations, the wicket apertures 170 may be formed in the second edge region 218 of the continuous length of material 210. The wicket apertures 170 may be intermittently spaced at various increments in the machine direction MD. Various methods may be used to form the wicket apertures 170, including various mechanical or thermal cutting operations such as die cutting or laser cutting. The wicket apertures 170 may be sized such that a wicket may be inserted through each wicket aperture.

Figure 15:
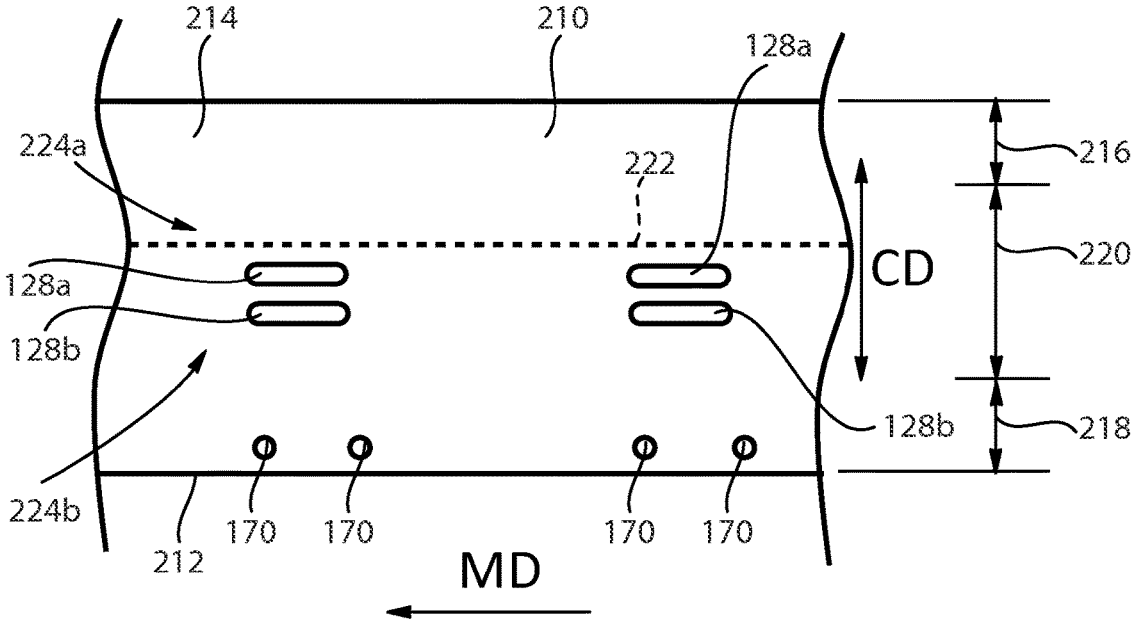
FIG. 15 is a schematic, plan view of a continuous length of material having a continuous line of weakness, a plurality of intermittently spaced wicket apertures, and first and second rows of intermittently spaced handle apertures.

Moreover, as shown in FIG. 15, first and second rows 224*a* and 224*b* of intermittently spaced handle apertures 128*a* and 128*b* may be formed in the continuous length of material 210 along the machine direction MD. The handle apertures 128 may be positioned in various cross-directional locations. In some exemplary configurations, as shown in FIG. 15, the first and second rows 224*a* and 224*b* of handle apertures 128*a* and 128*b* may be formed along the central region 220 of the continuous length of material 210. The handle apertures 228 may be intermittently spaced at various increments in the machine direction MD. Various methods may be used to form the handle apertures 228, including various mechanical or thermal cutting operations such as die cutting or laser cutting. The handle apertures 228 may be sized such that at least two fingers and/or a palm of a human hand may be inserted through the handle aperture 228. The steps of forming the wicket apertures 170 and the handle apertures 228 may occur concurrently, or in some exemplary configurations, may occur sequentially.

Figure 16:
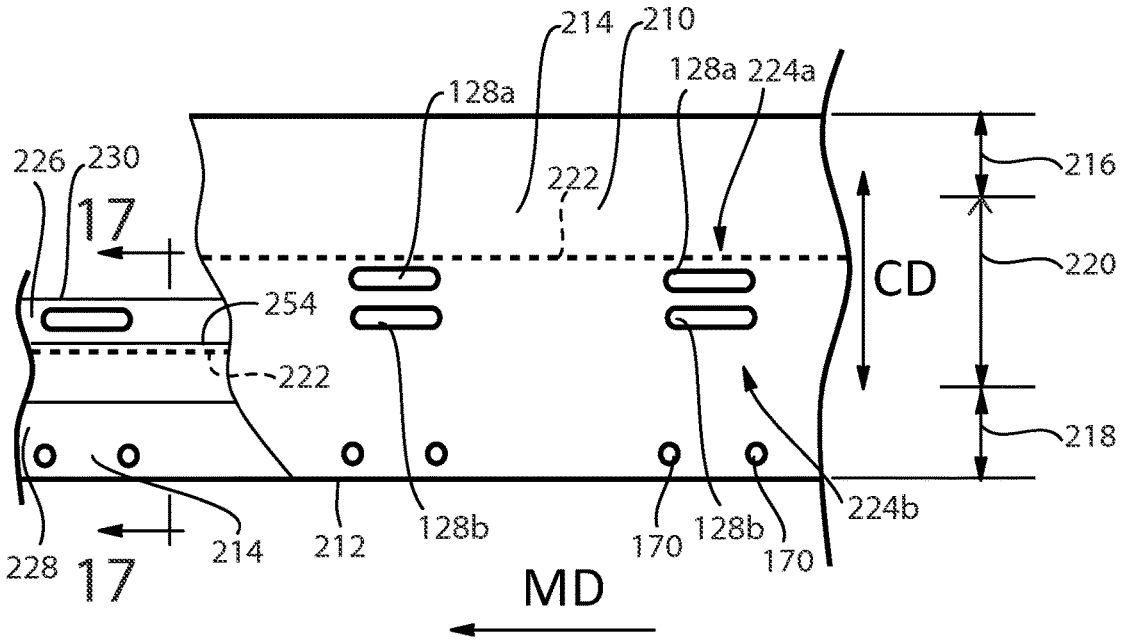
FIG. 16 is a schematic, plan view of a continuous length of material folded about a first continuous fold.
Figure 17:
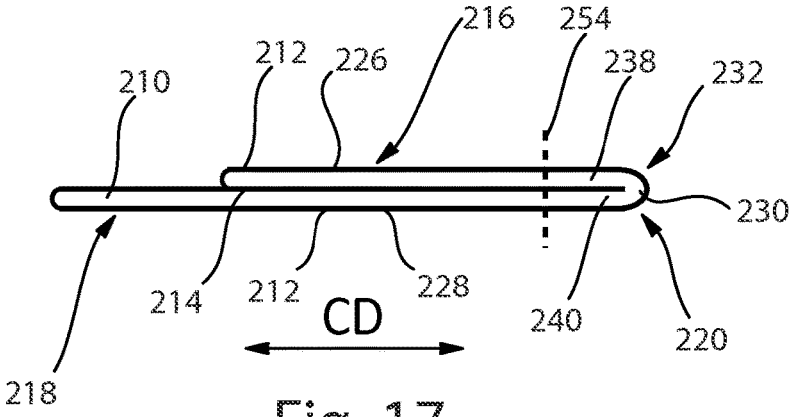
FIG. 17 is a schematic, cross-sectional view of the continuous length of material of FIG. 16 taken along line 17-17.

With reference to FIGS. 16 and 17, the continuous length of material 210 may be folded in the cross direction CD along the central region 220 to form a first continuous panel 226 and a second continuous panel 228 joined along a first continuous fold 230. The first continuous fold 230 may extend in the machine direction MD. The first continuous fold 230 may be configured in a C-shape. The second sides 214 of the first and second continuous panels 226 and 228 may be arranged in a face-to-face orientation. The first fold 230 may be positioned in various locations relative to the first and second edge regions 216 and 218 of the continuous length of material 210. As such, in some exemplary configurations, the first fold 230 may be positioned equidistant from the first and second edge regions 216 and 218. In other exemplary configurations, the first fold 230 may be positioned relatively nearer to either of the first or second edge regions 216 or 218. In some exemplary configurations such as shown in FIG. 16, the first continuous fold 230 may be positioned between the first and second rows 224*a* and 224*b* of handle apertures 128. In such an exemplary configuration, folding the continuous length of material 210 about the first continuous fold 230 may align the handle apertures 128*a* from the first row 224*a* with the handle apertures 128*b* from the second row 224*b*.

In an exemplary configuration shown in FIGS. 16 and 17, after folding the continuous length of material 210 about the first continuous fold 230, a continuous seam 254 may be formed proximate to the first and second rows 224*a* and 224*b* of handle apertures 128 along the machine direction MD. The first and second rows 224*a* and 224*b* of handle apertures 128 may be positioned between the first continuous fold 230 and the continuous seam 254. As a result, a continuous pleat 232 is formed in the continuous length of material 210. The continuous pleat 232 may include a first continuous pleated portion 238 and a second continuous pleated portion 240 connected along the first continuous fold 230. The first pleated portion 238 may include the first row 224*a* of handle apertures 128 and the second pleated portion 240 may include the second row 224*b* of handle apertures 128. The first pleated portion 238 and the second pleated portion 240 may be configured in a face-to-face relationship in substantially parallel planes.

Figure 18:
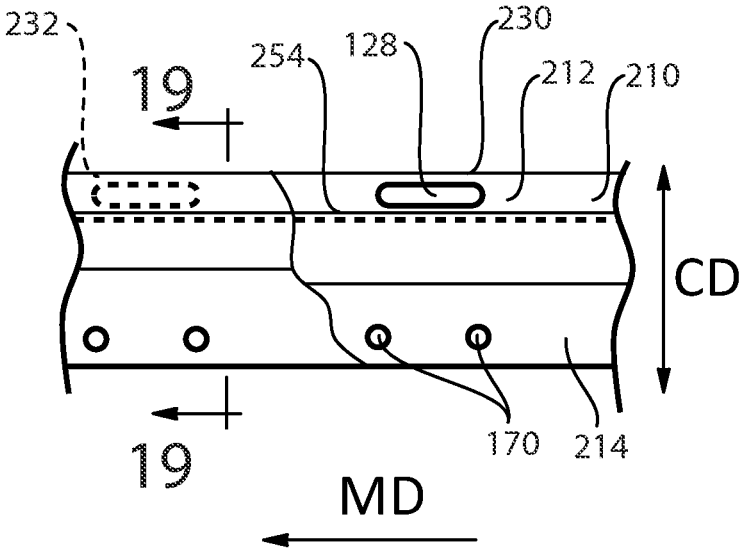
FIG. 18 is a schematic, plan view of a continuous length of material folded about second and third continuous folds to form a first continuous gusset.
Figure 19:
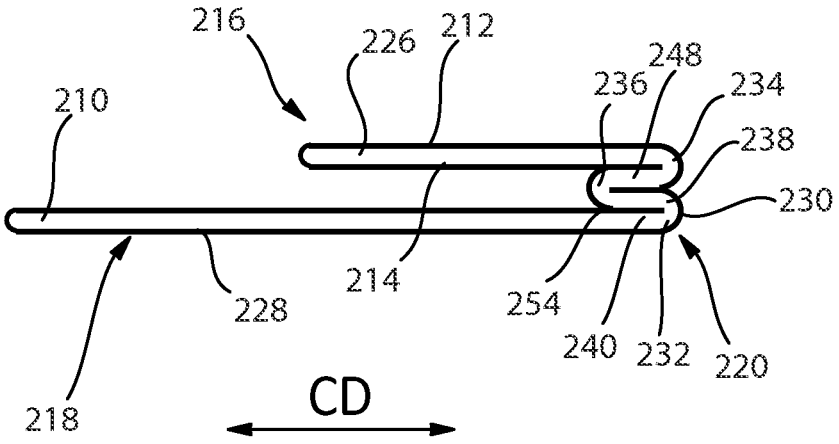
FIG. 19 is a schematic, cross-sectional view of the continuous length of material of FIG. 18 taken along line 19-19.

With reference to FIGS. 18 and 19, the continuous length of material 210 may be folded to form a first continuous gusset 248. In particular, a portion of the first side 212 of the continuous length of material 210 may be directed toward the first pleated portion 238 of the continuous pleat 230 such that second and third continuous folds 234 and 236 are formed along the machine direction MD. The second and third continuous folds 234 and 236 may be located in various cross-directional CD positions. The second and third continuous folds 234 and 236 may be configured as C-shape folds. The continuous seam 254 may extend contiguously with the third continuous fold 236.

Figure 20:
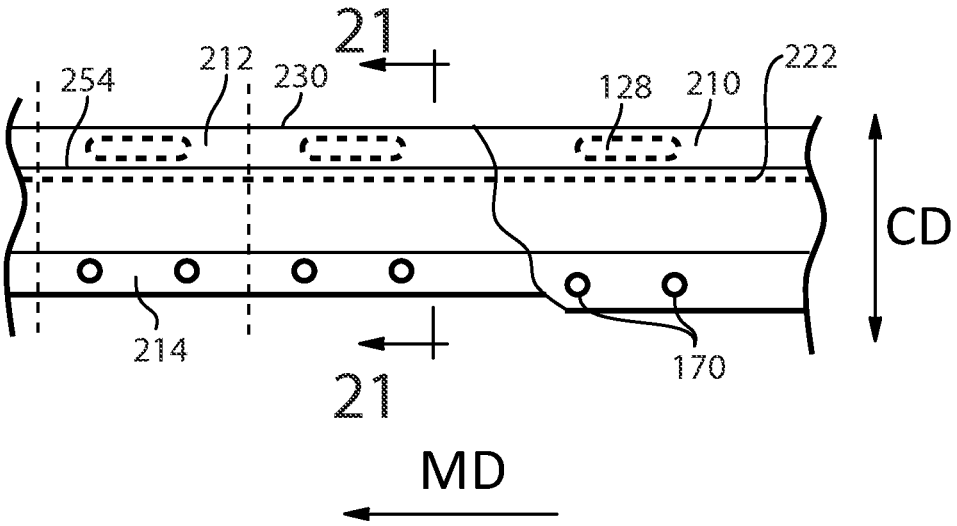
FIG. 20 is a schematic, plan view of a continuous length of material folded about fourth and fifth fold lines to form a second continuous gusset.
Figure 21:
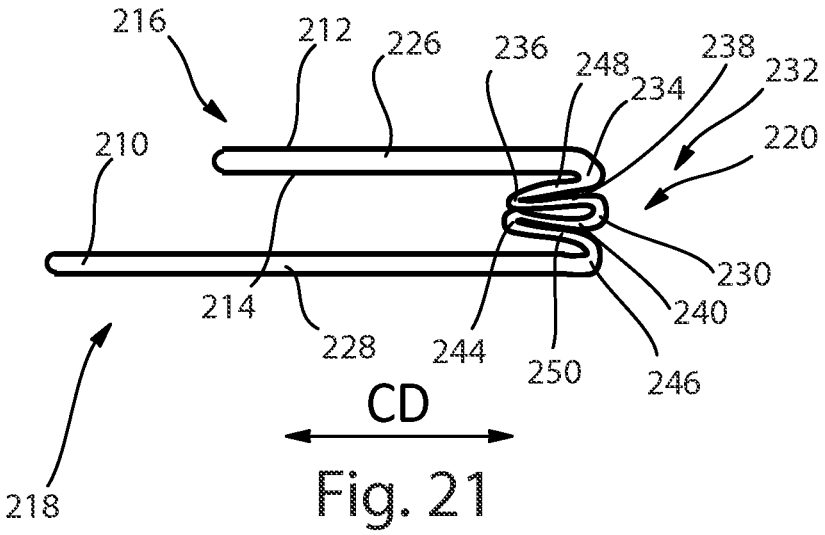
FIG. 21 is a schematic, cross-sectional view of the continuous length of material of FIG. 20 taken along line 21-21.

With reference to FIGS. 20 and 21, in some exemplary configurations, a second continuous gusset 250 may be formed in the continuous length of material 210. To form the second continuous gusset 250, the continuous length of material 210 may be folded by directing a portion of the first side 212 of the continuous length of material 210 comprising the second pleated portion 240 of the continuous pleat 232 toward another portion of the first side 212 of the continuous length of material 210 such that a fourth continuous fold 244 and a fifth continuous fold 246 are formed along the machine direction MD. Upon folding the continuous length of material 210 to form the second continuous gusset 250, the second continuous panel 228 may extend beyond the first continuous panel 226 in the cross direction CD. As shown in FIG. 21, in an exemplary configuration wherein the continuous pleat 232 is interconnected between the first and second continuous gussets 248 and 250, the first continuous gusset 248 may be interconnected between the second continuous fold 234 and the third continuous fold 236 and the second continuous gusset 250 may be interconnected between the fourth and fifth continuous folds 244 and 246.

In some exemplary configurations, the first and second continuous gussets 248 and 250 and the continuous pleat 232 may each extend in the machine direction MD. As such, the same or similar equipment may be used to fold the continuous length of material 210 to form the first and second continuous gussets 248 and 250 and the continuous pleat 232. Additionally, a manufacturing line configured to manufacture a wicketed bag having a gusset may require only minimal changes to manufacture a wicketed bag having both an integrated handle and a gusset. In some exemplary configurations, the first and second continuous gussets 248 and 250 and the continuous pleat 232 may be formed concurrently. In other exemplary configurations, the first and second continuous gussets 248 and 250 and the continuous pleat 232 may be formed sequentially.

Figure 22:
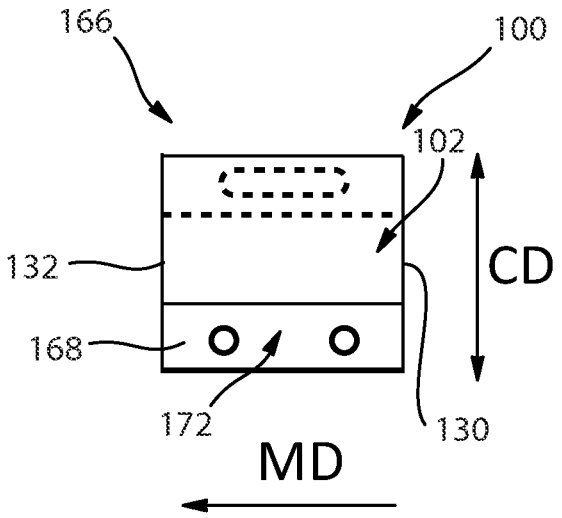
FIG. 22 is a schematic, plan view of a wicketed bag having a wicket panel.

With reference to FIGS. 20 and 22, in another step, the continuous length of material 210 may be cut in the cross direction CD between adjacent handle apertures 128 to form discrete wicketed bags 166. The continuous length of material 210 may be cut using various cutting apparatuses, such as a rotary knife cutter, a die cutter, or a laser cutter, for example.

The process of forming wicketed bags 166 may include the step of seaming the right and left side edge portions of the first panel, the second panel, the pleat, and the gusset. With reference to FIGS. 1, 2, 3, and 22, a first seam 130 may be formed in the right side edge portions 106, 107, 122, and 146 of the first panel 102, the second panel 104, the pleat 120, and the gusset 140, respectively. A second seam 132 may be formed in the left side edge portions 108, 109, 124, and 148 of the first panel 102, the second panel 104, the pleat 120, and the gusset 140, respectively. The first and second seams 130 and 132 may be formed in various ways, including ultrasonic welding, hot air seaming, adhesives, and the like. In some exemplary configurations, the steps of cutting the continuous length of material 210 to form discrete wicketed bags 166 and forming the first and/or second seams 130 and 132 may occur concurrently. In other exemplary configurations, the steps of cutting and seaming may occur sequentially.

With reference to FIGS. 8A, 9, and 22, an opening 172 is defined by the second end portions 112 and 113 of the first and second panels 102 and 104. The wicketed bags 166 may be filled with absorbent articles by inserting the absorbent articles through the opening 172. As discussed above, the absorbent articles may be folded about a lateral axis prior to inserting the absorbent articles into the wicketed bag. The absorbent articles may be arranged in a row with the folded end of the absorbent articles facing the gusset 140 of the wicketed bag. In some exemplary configurations, two or more rows of absorbent articles may be inserted into the wicketed bag 166.

Figure 23:
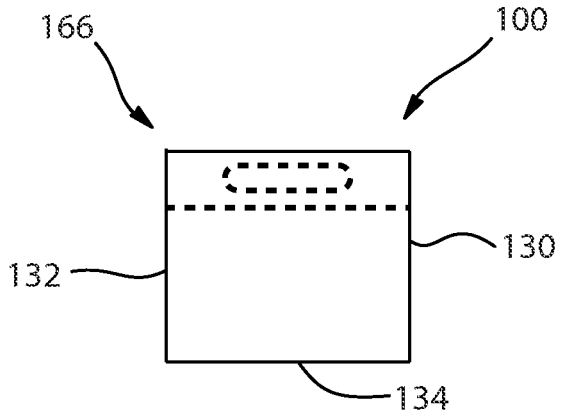
FIG. 23 is a schematic, plan view of a wicketed bag without a wicket panel.

With reference to FIGS. 3 and 23, once the wicketed bag 166 is filled with absorbent articles, the second end portions 112 and 113 of the first and second panels 102 and 104 may be joined together to form a third seam 134. Like the first and second seams 130 and 132, the third seam 134 may be formed in various ways.

Additionally, the wicket panel 168 may be cut away from the second panel 104 to form the package 100 such as shown in FIGS. 1 and 2. In some exemplary configurations, the steps of forming the third seam 134 and cutting the wicket panel 168 may occur concurrently. In other exemplary configurations, the steps of forming the third seam 134 and cutting the wicket panel 168 may occur sequentially. Various methods may be used to cut the wicket panel 168 from the second panel 104. Exemplary cutting apparatuses include knife rolls, die cutters, and lasers. As shown in FIGS. 4A and 4B, the package 100 may generally take the shape of the row of absorbent articles 200 contained therein.

It is to be appreciated that the steps described above for forming a wicketed bag may be performed in various orders. Additionally, some steps may overlap or occur concurrently, while other steps may occur sequentially.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package comprising:

a first panel, wherein the first panel defines a right side edge portion, a left side edge portion, a first end portion, and a second end portion;

a second panel, wherein the second panel defines a right side edge portion, a left side edge portion, a first end portion, and a second end portion, wherein the first and second panels combine to define an interior and an exterior of the package;

a gusset having a first gusset panel and a second gusset panel;

a pleat positioned between the first end portions of the first and second panels, wherein the pleat defines a right side edge portion and a left side edge portion, and wherein the pleat defines a first pleated portion and a second pleated portion connected at a first fold, and wherein the pleat comprises a handle aperture defined in the first pleated portion and the second pleated portion to form a handle; and wherein the first gusset panel interconnects the pleat and the first end portion of the first panel and the second gusset panel interconnects the pleat and the first end portion of the second panel, wherein a first seam joins the right side edge portions of the first panel, the second panel, and at least a portion of the pleat such that the pleat lays substantially flat while unengaged by a user, wherein a second seam joins the left side edge portions of the first panel, the second panel, and at last a portion of the pleat such that the pleat lays substantially flat while unengaged by a user, wherein a third seam joins the second end portion of the first panel with the second end portion of the second panel, wherein a fourth seam joins the pleat with the first end portion of the first panel and the first end portion of the second panel, wherein the fourth seam extends generally parallel to the first fold, and wherein the first fold is opposite the fourth seam.

2. The package of claim 1, further comprising a line of weakness extending between the pleat and the second gusset panel.

3. The package of claim 2, wherein the package is hermetically sealed prior to opening the package at the line of weakness.

4. The package of claim 1 further comprising absorbent articles contained within the interior of the package.

5. The package of claim 4, wherein placement of the absorbent articles into the interior of the package forms a top panel, a bottom panel, a front panel, a back panel, and two side panels, wherein the pleat defines a portion of the top panel of the package.

6. The package of claim 1, wherein the first panel, the second panel, and the pleat comprise a polymeric plastic film.

7. The package of claim 6, wherein the polymeric plastic film is selected from the group consisting of polyethylene, polypropylene, or any combination thereof.

8. The package of claim 1, wherein the first fold is configured in a C-shape.

9. A package comprising:

a first panel, wherein the first panel defines a right side edge portion, a left side edge portion, a first end portion, and a second end portion;

a second panel, wherein the second panel defines a right side edge portion, a left side edge portion, a first end portion, and a second end portion, wherein the first and second panels combine to define an interior and an exterior of the package;

a gusset having a first gusset panel and a second gusset panel;

a pleat positioned between the first end portions of the first and second panels, wherein the pleat defines a right side edge portion and a left side edge portion, and wherein the pleat defines a first pleated portion and a second pleated portion connected at a first fold, and wherein the pleat comprises a handle aperture defined in the first pleated portion and the second pleated portion to form a handle; and wherein the first gusset panel interconnects the pleat and the first end portion of the first panel and the second gusset panel interconnects the pleat and the first end portion of the second panel, wherein a first seam joins the right side edge portions of the first panel, the second panel, and at least a portion of the pleat such that the pleat lays substantially flat while unengaged by a user, wherein a second seam joins the left side edge portions of the first panel, the second panel, and at least a portion of the pleat such that the pleat lays substantially flat while unengaged by a user, wherein a third seam joins the second end portion of the first panel with the second end portion of the second panel, wherein a fourth seam joins the pleat with the first end portion of the first panel and the first end portion of the second panel, and wherein the fourth seam extends from the right side edge portion to the left side edge portion, and wherein the handle aperture is positioned between the fourth seam and the first fold.

10. The package of claim 9, further comprising a line of weakness extending between the pleat and the second gusset panel.

11. The package of claim 10, wherein the package is hermetically sealed prior to opening the package at the line of weakness.

12. The package of claim 9, wherein the pleat lays substantially flat against the first gusset panel or the second gusset panel.

13. The package of claim 9, wherein placement of absorbent articles into the interior of the package forms a top panel, a bottom panel, a front panel, a back panel, and two side panels, wherein the pleat defines a portion of the top panel of the package.

14. The package of claim 9, wherein the fourth seam is generally parallel to the first fold.

15. The package of claim 4, wherein the aperture overlies and faces the absorbent articles contained within the interior of the package.

16. The package of claim 9, further comprising absorbent articles contained within the interior of the package, wherein the aperture overlies and faces the absorbent articles contained within the interior of the package.

17. The package of claim 1, wherein the pleat lays substantially flat against at the first gusset panel or the second gusset panel when the handle is unengaged by a user.

18. The package of claim 1, wherein the first pleated portion lays substantially flat against the first gusset panel.

19. The package of claim 9, wherein the pleat lays substantially flat against the first gusset panel or the second gusset panel.

* * * * *